US008513160B2

(12) United States Patent
Hada et al.

(10) Patent No.: US 8,513,160 B2
(45) Date of Patent: Aug. 20, 2013

(54) HEAT-SENSITIVE RECORDING MATERIAL AND METHOD FOR PRODUCING SAME

(75) Inventors: Toshiro Hada, Amagasaki (JP); Masaaki Shimizu, Amagasaki (JP); Yasuyuki Aoki, Amagasaki (JP); Naotaka Endo, Amagasaki (JP); Hiroyuki Ohhashi, Amagasaki (JP); Tomokazu Ishiguro, Amagasaki (JP)

(73) Assignee: OJI Holdings Corporation, Tokyo (JP)

( * ) Notice: Subject to any disclaimer, the term of this patent is extended or adjusted under 35 U.S.C. 154(b) by 174 days.

(21) Appl. No.: 13/254,045

(22) PCT Filed: Feb. 16, 2010

(86) PCT No.: PCT/JP2010/052271

§ 371 (c)(1),
(2), (4) Date: Aug. 31, 2011

(87) PCT Pub. No.: WO2010/101020

PCT Pub. Date: Sep. 10, 2010

(65) Prior Publication Data

US 2011/0318511 A1 Dec. 29, 2011

(30) Foreign Application Priority Data

Mar. 2, 2009 (JP) ..... 2009-047469
Apr. 17, 2009 (JP) ..... 2009-100669

(51) Int. Cl.
*B41M 5/42* (2006.01)

(52) U.S. Cl.
USPC ..... 503/226; 427/152

(58) Field of Classification Search
None
See application file for complete search history.

(56) References Cited

U.S. PATENT DOCUMENTS

| | | | | |
|---|---|---|---|---|
| 4,833,116 | A | 5/1989 | Yamori | |
| 6,339,041 | B1 | 1/2002 | Aono | |
| 2002/0187897 | A1 | 12/2002 | Ishida et al. | 503/226 |

FOREIGN PATENT DOCUMENTS

| | | | |
|---|---|---|---|
| JP | 2-53239 | B2 | 11/1990 |
| JP | 3-166984 | | 7/1991 |
| JP | 9-234957 | | 9/1997 |
| JP | 2000-118138 | | 4/2000 |
| JP | 2001-310557 | A1 | 11/2001 |
| JP | 2001-322355 | | 11/2001 |
| JP | 3714112 | B2 | 11/2005 |

OTHER PUBLICATIONS

Extended European Search Report issued in corresponding application No. 10748616.9 dated Jul. 5, 2012 (6 pages).
International Search Report for International Application No. PCT/JP2010/052271 dated Mar. 9, 2010.

*Primary Examiner* — Bruce H Hess
(74) *Attorney, Agent, or Firm* — Kratz, Quintos & Hanson, LLP

(57) ABSTRACT

The present invention provides a heat-sensitive recording material that has high gloss and excellent absorption and scratch off properties against sebum soiling; and a method for producing the heat-sensitive recording material. More specifically, the present invention provides a heat-sensitive recording material containing a heat-sensitive recording layer, an intermediate layer, and a protective layer, which are sequentially formed in this order on a support. The heat-sensitive recording layer contains a leuco dye and a developer; the intermediate layer contains an aqueous adhesive; and the protective layer is cured by irradiation of an ultraviolet- or electron-beam-curable resin composition with ultraviolet light or an electron beam. The heat-sensitive recording material additionally contains, on the protective layer, an uppermost layer which contains an aqueous adhesive and a pigment having a mean particle diameter of not more than 100 nm. The uppermost layer-side surface of the heat-sensitive recording material has a gloss at 75° of not less than 90% and a gloss at 20° of not less than 35% in accordance with JIS P 8142-1993. The present invention further provides a method for producing the heat-sensitive recording material.

12 Claims, No Drawings

HEAT-SENSITIVE RECORDING MATERIAL AND METHOD FOR PRODUCING SAME

TECHNICAL FIELD

The present invention relates to a heat-sensitive recording material that utilizes a color-forming reaction between a leuco dye and a developer, and to a method for producing the heat-sensitive recording material.

BACKGROUND ART

Heat-sensitive recording materials that utilize a thermal color-forming reaction between a leuco dye and a developer are well known. Such heat-sensitive recording materials are relatively inexpensive, and recording devices are relatively compact and easily maintained. Therefore, such heat-sensitive recording materials have been widely used as recording media for facsimile machines, various labels, and other types of output, and also as recording media for the printers of medical diagnostic devices for ultrasound imaging, X-ray imaging, etc.

Heat-sensitive recording materials containing synthetic paper having a multiple-layer structure or a biaxially oriented thermoplastic resin film optionally containing an inorganic pigment as a support are currently used for the printers of medical diagnostic devices, in which uniform recorded images and high resolution are required. In recent years, there has been increasing demand for a heat-sensitive recording material that has excellent gradation reproducibility from low to high density and that can provide a high-quality recorded image with a high gloss that is equivalent to a silver halide photograph.

To enhance printing preservability and printing suitability, Patent Literature (PTL) 1 proposes a heat-sensitive recording material comprising a heat-sensitive recording layer; an intermediate layer containing an aqueous resin that is formed on the heat-sensitive recording layer; and a protective layer containing a resin cured by electron beam irradiation that is formed on the intermediate layer; and further comprising an overcoat layer containing a pigment that is formed on the protective layer. However, a protective layer containing a resin cured by electron beam irradiation is generally highly hydrophobic and has a low wetting tension. Therefore, it is extremely difficult to uniformly apply a pigment dispersion containing water as a medium to the protective layer to form a coating film thereon. If the thickness of the overcoat layer is increased to provide a uniform coating film, gloss, recording density, coating adhesion, etc., are sharply reduced.

To form a uniform coating film with enhanced gloss, Patent Literature (PTL) 2 proposes a heat-sensitive recording material comprising a heat-sensitive recording layer, a first intermediate layer, a second intermediate layer containing a resin cured by the irradiation of an electron beam, and an overcoat layer mainly consisting of a pigment and an aqueous resin, which are successively layered in this order; and Patent Literature (PTL) 3 proposes a heat-sensitive recording material comprising a heat-sensitive recording layer, a first intermediate layer containing an aqueous resin, a second intermediate layer cured by ionizing radiation, and an uppermost layer containing an aqueous resin, which are sequentially formed in this order. However, in both of the above recording materials, the outermost layer is first formed on a highly smooth base material that is different from the support used in the heat-sensitive recording material, and then the outermost layer is transferred to the heat-sensitive recording layer side. Accordingly, partially uneven transfer results in poor recording surface quality, recorded image quality, gloss, etc. Moreover, the complicated steps of such a method lead to poor productivity, and entail a disposal problem for the highly smooth base material, etc. Furthermore, due to high smoothness of the outermost layer, soiling, such as that by sebum and perspiration, which adheres to the surface of the heat-sensitive recording material when the surface is touched with a bare hand, is prone to be transferred to the thermal head surface of a printer, thus causing printing failures, such as printing scratches and white streaks.

To prevent components of the heat-sensitive recording material from adhering as residues to the thermal head surface, Patent Literature (PTL) 4 proposes a heat-sensitive recording material comprising a protective layer containing a silicone modified polymer and inorganic ultrafine particles having a particle diameter of 0.1 μm or less. However, because the use of a silicone modified polymer lowers the wetting tension of the protective layer surface, dust and other foreign matter that enter and adhere to the protective layer of the heat-sensitive recording material, particularly soiling substances such as sebum and perspiration that adhere when the surface is touched with a bare hand, are prone to be transferred to the thermal head during recording. Furthermore, due to increased lubricity between the protective layer surface and the thermal head during printing, soiling, etc., once transferred cannot be easily scratched off. As a result, soiling such as sebum and perspiration tends to accumulate as a residue on the thermal head surface, and most likely causes printing failures, such as scratches and white streaks. In addition, once such a problem occurs, it is difficult to resolve. Furthermore, the application of a coating composition containing inorganic ultrafine particles with a particle diameter of 0.1 μm or less tends to result in uneven coating, etc.; therefore, satisfactory results are not always obtained.

To obtain a high-quality recorded image with a high gloss, Patent Literature (PTL) 5 proposes forming, on an intermediate layer containing an aqueous resin, a protective layer comprising an electron-beam-curable resin composition cured by electron beam irradiation. However, when the protective coating layer surface has a gloss at 75° of not less than 90% and a gloss at 20° of not less than 35% as measured in accordance with JIS P 8142-1993, soiling such as that by sebum and perspiration that adheres to the heat-sensitive recording material when it is touched with a bare hand sticks to the thermal head during recording, thus causing recording failures such as streaks. Therefore, no heat-sensitive recording material that is excellent in terms of both running performance in the recording and gloss has yet been obtained.

Patent Literature (PTL) 6 proposes a method for manufacturing a heat-sensitive recording material, comprising forming on a support a heat-sensitive recording layer and a first intermediate layer; applying to the first intermediate layer a second intermediate coating composition containing an ionizing-radiation-curable compound to form a second intermediate coating layer surface; forming an aqueous resin-containing uppermost layer on a film that is different from the support; adhering the second intermediate coating layer surface to the uppermost layer and curing the second intermediate coating layer by irradiation with ionizing radiation; and then peeling off the film, thereby providing a heat-sensitive recording material that is excellent in terms of running performance in the recording, recorded image quality, and gloss. However, considering the quality deterioration caused by uneven peeling or the necessity of using a film in a step of the manufacturing method, there is room for further improvement in productivity.

CITATION LIST

Patent Literature

PTL 1: Japanese Unexamined Patent Publication No. H3-166984
PTL 2: Japanese Unexamined Patent Publication No. H9-234957
PTL 3: Japanese Unexamined Patent Publication No. 2001-310557
PTL 4: Japanese Unexamined Patent Publication No. 2000-118138
PTL 5: Japanese Unexamined Patent Publication No. H2-53239
PTL 6: Japanese Patent No. 3714112

SUMMARY OF INVENTION

Technical Problem

A primary object of the present invention is to provide a heat-sensitive recording material that has high gloss and excellent absorption and scratch off properties against sebum soiling; and a method for producing the heat-sensitive recording material.

Solution to Problem

The present inventors carried out extensive research in view of the problem of the prior art. As a result, the inventors have found a solution to the problem. More specifically, the present invention provides the following heat-sensitive recording material and method for producing the heat-sensitive recording material.

Item 1: A heat-sensitive recording material comprising a heat-sensitive recording layer, an intermediate layer, and a protective layer, which are sequentially formed in this order on a support, wherein the heat-sensitive recording layer contains a leuco dye and a developer; the intermediate layer contains an aqueous adhesive; and the protective layer is a cured form obtained by irradiation of an ultraviolet- or electron-beam-curable resin composition with ultraviolet light or an electron beam; the heat-sensitive recording material further comprising, on the protective layer, an uppermost layer containing an aqueous adhesive and a pigment having a mean particle diameter of not more than 100 nm, wherein the uppermost layer-side surface of the heat-sensitive recording material has a gloss at 75° of not less than 90% and a gloss at 20° of not less than 35% in accordance with JIS P 8142-1993.

Item 2: The heat-sensitive recording material according to item 1, wherein the uppermost layer contains an aqueous adhesive comprising a polyurethane ionomer.

Item 3: The heat-sensitive recording material according to item 1 or 2, wherein the pigment comprises one member selected from the group consisting of layered silicate compounds and colloidal silica, and the content of one member selected from the group consisting of layered silicate compounds and colloidal silica is 20 to 70 mass %, based on the total solids content of the uppermost layer.

Item 4: The heat-sensitive recording material according to any one of items 1 to 3, wherein the uppermost layer contains a resin obtained from the aqueous adhesive, which is a polymer latex having a heterogeneous particle structure containing a urethane resin component in at least one phase.

Item 5: The heat-sensitive recording material according to any one of items 1 to 4, wherein the uppermost layer has an average thickness of 0.02 to 0.4 μm, and the average thickness is not less than a mean particle diameter of the pigment.

Item 6: The heat-sensitive recording material according to any one of items 1 to 5, wherein the protective layer contains a filler having a 50% mean volume particle diameter (D50) of less than 2.0 μm as determined from the cumulative volume distribution, and a ratio of the 90% mean volume particle diameter (D90) to the 50% mean volume particle diameter (D50) (D90/D50) of not more than 3.0, and the protective layer has an average thickness of 0.5 to 5 μm, and the average thickness is not less than a mean particle diameter of the filler.

Item 7: The heat-sensitive recording material according to any one of items 1 to 6, wherein the protective layer contains at least one filler selected from the group consisting of synthetic zeolite and spherical silica.

Item 8: The heat-sensitive recording material according to any one of items 1 to 7, wherein the protective layer surface has a gloss at 75° of not less than 90% in accordance with JIS P 8142-1993 and a wetting tension of not less than 50 mN/m.

Item 9: The heat-sensitive recording material according to any one of items 1 to 8, wherein the uppermost layer is formed by using an uppermost layer coating composition containing an alkyl phosphate;

an alkali metal pyrophosphate; and at least one thickener selected from the group consisting of acrylic alkali thickeners, polyethylene oxide, xanthan gum, and sodium polyacrylate; and wherein the alkyl phosphate content is 0.5 to 10 mass %, based on the total solids content of the uppermost layer, and the alkali metal pyrophosphate content is 3 to 20 mass %, based on the pigment.

Item 10: The heat-sensitive recording material according to item 9, wherein the acrylic alkali thickener content is 0.1 to 3 mass %, based on the total solids content of the uppermost layer.

Item 11: The heat-sensitive recording material according to item 9 or 10, wherein the content of at least one member selected from the group consisting of polyethylene oxide, xanthan gum, and sodium polyacrylate is 0.05 to 0.5 mass %, based on the total solids content of the uppermost layer.

Item 12: A method for producing a heat-sensitive recording material according to any one of items 1 to 11, wherein the heat-sensitive recording material comprising a heat-sensitive recording layer, an intermediate layer, and a protective layer, which are sequentially formed in this order on a support, the heat-sensitive recording layer containing a leuco dye and a developer, the intermediate layer containing an aqueous adhesive, and the protective layer being cured by irradiation of an ultraviolet- or electron-beam-curable resin composition with ultraviolet light or an electron beam, applying to the protective layer an uppermost layer coating composition containing an aqueous adhesive and a pigment with a mean particle diameter of not more than 100 nm and drying the composition to form an uppermost layer, wherein the uppermost layer-side surface has a gloss at 75° of not less than 90% and a gloss at 20° of not less than 35% in accordance with JIS P 8142-1993.

Advantageous Effects of Invention

The heat-sensitive recording material of the present invention has high gloss and excellent absorption and scratch off properties against sebum soiling. The heat-sensitive recording material of the invention also exhibits excellent quality in the recorded image and sticking resistance.

DESCRIPTION OF EMBODIMENTS

An example of a support usable in the present invention is synthetic paper, which is produced by a method comprising kneading a polyolefin resin and a white inorganic pigment while heating the mixture; extruding the melt from a die; and stretching the extrudate in the lengthwise direction; forming on each side of the stretched extrudate one or two layers of a film comprising a polyolefin resin and a white inorganic pigment; and stretching the layered film in the widthwise direction to make the film translucent or opaque. Another example of a support is a film produced by a method comprising heating and kneading a thermoplastic resin, such as polyethylene, polypropylene, polystyrene, and polyester, either alone or in combination; extruding the melt from a die; and biaxially stretching the extrudate. Another example of a support is an opaque film produced by a method comprising mixing such a resin as mentioned above with a white inorganic pigment, and biaxially stretching the mixture. Other examples of usable supports include paper made of pulp fibers such as high-quality paper, medium quality paper, acid-free paper, recycled paper, and coated paper; composite base materials formed by laminating or otherwise layering such paper; and thermoplastic-resin-coated paper formed by coating one or both sides thereof with a thermoplastic resin. The weight of the support is about 20 to 250 g/m$^2$.

The heat-sensitive recording layer used in the present invention is not particularly limited insofar as a recorded image can be formed thereon by heating. The heat-sensitive recording layer may contain an electron-donating compound and an electron-accepting compound as color-forming components. If necessary, the heat-sensitive recording layer may contain a stability-improving agent, a sensitizer, etc. Examples of color-forming components include a combination of a leuco dye and a developer; a combination of an imino compound and an isocyanate compound; a combination of a long chain fatty acid metal salt and a polyphenol; and a combination of a chelate compound and a transition element, such as iron, cobalt, or copper. The combination of a leuco dye and a developer, which can achieve excellent recording sensitivity and recording density, is described below in more detail.

Examples of leuco dyes include 3-[2,2-bis(1-ethyl-2-methylindol-3-yl)vinyl]-3-(4-diethylaminophenyl)phthalide, 3,3-bis(p-dimethylaminophenyl)-6-dimethylaminophthalide, 3-(4-diethylamino-2-methylphenyl)-3-(4-dimethylaminophenyl)-6-dimethylaminophthalide, 3-diethylamino-6-methyl-7-anilinofluoran, 3-diethylamino-6-methyl-7-chlorofluoran, 3-diethylamino-6,8-dimethylfluoran, 3-diethylamino-7-chlorofluoran (PSD-HR), 3-diethylamino-7-(m-trifluoromethyl)anilinofluoran, 3-(N-methyl-N-cyclohexyl)amino-6-methyl-7-anilinofluoran, 3-(N-ethyl-N-isoamyl)amino-6-methyl-7-anilinofluoran, 3-di(n-butyl) amino-6-methyl-7-anilinofluoran, 3-di(n-butyl)amino-7-(o-chloroanilino)fluoran, 3-di(n-pentyl)amino-6-methyl-7-anilinofluoran, 3-(N-ethyl-p-toluidino)-6-methyl-7-anilinofluoran, 3-(N-cyclohexyl-N-methylamino)-6-methyl-7-anilinofluoran, 3-di (n-butyl)amino-6-chloro-7-anilinofluoran, 3-pyrrolidino-6-methyl-7-anilinofluoran, 3-piperidino-6-methyl-7-anilinofluoran, 3,3-bis[1-(4-methoxyphenyl)-1-(4-dimethylaminophenyl)ethlen-2-yl]-4,5,6,7-tetrachlorophthalide, 3-p-(p-dimethylaminoanilino) anilino-6-methyl-7-chlorofluoran, 3-p-(p-anilinoanilino) anilino-6-methyl-7-chlorofluoran, 3-(4-diethylamino phenyl)-3-(1-ethyl-2-methylindol-3-yl)phthalide, 3,3-bis(1-n-butyl-2-methylindol-3-yl)phthalide, 3,6-bis(dimethylamino)fluorene-9-spiro-3'-(6'-dimethylamino)phthalide, 3-diethylamino-6-methyl-7-(3-toluidino)fluoran, 3,3-bis(4-diethylamino-2-ethoxyphenyl)-4-azaphthalide, 3-(N-ethyl-N-tetrahydrofurfuryl)amino-6-methyl-7-anilinofluoran, and 3-(N-ethyl-p-toluidino)-6-methyl-7-(p-toluidino)fluoran. Such leuco dyes can be used singly or in a combination of two or more.

The leuco dye content is not particularly limited. The heat-sensitive recording layer may contain a leuco dye in an amount of about 5 to 45 mass %, and preferably about 10 to 40 mass %, based on the total solids content of the heat-sensitive recording layer.

Examples of developers include 4,4'-isopropylidenediphenol, 4,4'-cyclohexylidenediphenol, benzyl 4-hydroxybenzoate, 4,4'-dihydroxydiphenylsulfone, 2,4'-dihydroxydiphenylsulfone, 4-hydroxy-4'-allyloxydiphenylsulfone, 4-hydroxy-4'-isopropoxydiphenylsulfone, 1,1-bis(4-hydroxyphenyl)ethane, 1,1-bis(4-hydroxyphenyl)-1-phenylethane, 3,3'-diallyl-4,4'-dihydroxydiphenylsulfone, 2,2'-[4-(4-hydroxy-phenylsulfonyl)phenoxy]diethyl ether, 1,4-bis[(α-methyl-α-(4'-hydroxyphenyl)ethyl)]benzene, and like phenolic compounds; 4,4'-bis[(4-methyl-3-phenoxycarbonylaminophenyl)ureido]diphenylsulfone, N-(p-toluenesulfonyl)-N'-(3-p-toluenesulfonyloxy)phenylurea, N,N'-di-m-chlorophenylthiourea, N-p-tolylsulfonyl-N'-phenylurea, N-(p-tolylsulfonyl)-N'-p-butoxy phenylurea, 4,4'-bis(p-toluenesulfonylaminocarbonylamino)diphenylmethane, and like compounds containing a sulfonyl group and a ureido group in the molecule; zinc 4-[2-(p-methoxyphenoxy)ethyloxy]salicylate, zinc 4-[3-(p-tolylsulfonyl)propyloxyl]salicylate, zinc 5-[p-(2-p-methoxyphenoxyethoxy)cumyl]salicylate, and like aromatic carboxylic acid zinc salt compounds. Such developers can be used singly or in a combination of two or more.

The developer content is not particularly limited, and can be suitably selected according to the kinds of leuco dye and developer used. The developer is preferably used in an amount of about 0.8 to 10 parts by mass, and preferably about 0.8 to 6 parts by weight, per part by mass of the leuco dye.

The heat-sensitive recording layer may contain a stability-improving agent to enhance the preservability of recorded portions. Examples of stability-improving agents include 1,1,3-tris(2-methyl-4-hydroxy-5-cyclohexylphenyl)butane, 1,1,3-tris(2-methyl-4-hydroxy-5-tert-butylphenyl)butane, 2,2'-methylenebis(4-ethyl-6-tert-butylphenol), 2,2'-ethylidenebis(4,6-di-tert-butylphenol), 1,3-bis[(α-methyl-α-(4'-hydroxyphenyl)ethyl)]benzene, 4,4'-thiobis(2-methyl-6-tert-butylphenol), 1,3,5-tris(4-tert-butyl-3-hydroxy-2,6-dimethylbenzyl)isocyanuric acid, and like phenols; 4-(2-methyl-1,2-epoxyethyl)diphenylsulfone, 4-(2-ethyl-1,2-epoxyethyl)diphenylsulfone, 4-benzyloxy-4'-(2-methylglycidyloxy)diphenylsulfone, and like diphenylsulfone epoxy compounds; and 2-(2'-hydroxy-5'-methylphenyl)benzotriazole, 2-hydroxy-4-benzyloxybenzophenone, 2-hydroxy-4-octyloxybenzophenon, and like ultraviolet absorbers.

If desired, the heat-sensitive recording layer may contain a sensitizer to enhance the recording sensitivity. Examples of sensitizers include stearamide, 1,2-di(3-methylphenoxy) ethane, 1,2-diphenoxyethane, p-benzylbiphenyl, naphthyl benzyl ether, benzyl-4-methylthiophenyl ether, phenyl-1-hydroxy-2-naphthoate, dibenzyloxalate, di-p-methylbenzyl oxalate, di-p-chlorobenzyl oxalate, dibutylterephthalate, dibenzylterephthalate, and dibutylisophthalate.

The heat-sensitive recording layer may contain at least one aqueous adhesive selected from the group consisting of water-soluble adhesives and water-dispersible adhesives. Examples of water-soluble adhesives include completely or partially saponified polyvinyl alcohols and derivatives thereof, starches and derivatives thereof, casein, gelatin, carboxymethyl cellulose, hydroxymethylcellulose, hydroxyethylcellulose, hydroxypropylcellulose, methylcellulose, ethylcellulose, and like cellulose derivatives, polyvinylpyrrolidone, alkali salts of acrylic acid polymers, alkali salts of ethylene-acrylic acid copolymers, alkali salts of styrene-acrylic acid copolymers, alkali salts of styrene-maleic anhydride copolymers, alkali salts of isobutylene-maleic anhydride copolymers, and acrylamide-acrylic acid copolymers. Examples of water-dispersible adhesives include vinyl acetate latex, urethane latex, acrylic latex, and styrene-butadiene latex. Such adhesives can be used singly or in a combination of two or more. The aqueous adhesive content is not particularly limited, and is preferably about 5 to 40 mass %, based on the total solids content of the heat-sensitive recording layer.

The heat-sensitive recording layer is formed by applying a heat-sensitive recording layer coating composition to a support to a coating thickness of about 2 to 20 g/m$^2$, and more preferably about 3 to 10 g/m$^2$, on a dry weight basis, and drying the composition. The heat-sensitive recording layer coating composition is prepared by dispersing and pulverizing, for example, a leuco dye and a developer, optionally with additives such as a sensitizer and a stability-improving agent, together or separately, in a dispersion medium, typically water, using an agitator or grinder such as a ball mill, attritor, or sand mill to a mean particle diameter of 3 μm or less, and more preferably 2 μm or less, and mixing the pulverized dispersion with an adhesive, preferably an aqueous adhesive.

The mean particle diameter of additives used in the recording heat-sensitive layer can be measured, for example, by a laser diffraction light-scattering method (using the SALD-2200 produced by Shimadzu Corporation, the LB-500 produced by Horiba, Ltd., the MT3300 produced by Nikkiso Co., Ltd., etc.); the centrifugal sedimentation method; or by using a commonly used particle size analyzer, such as a Coulter counter or an electron microscope.

The aqueous adhesive used in the heat-sensitive recording layer coating composition can be suitably selected from those usable for the uppermost layer. The aqueous adhesive content is not particularly limited, and is preferably about 5 to 40 mass %, based on the total solids content of the heat-sensitive recording layer.

The heat-sensitive recording layer coating composition may further contain other commonly used additives than mentioned above. Examples of such additives include surfactants, waxes, lubricants, pigments, water resistant additives (crosslinking agents), antifoaming agents, fluorescent brighteners, and color dyes. Examples of surfactants include sodium dioctylsulfosuccinate, sodium dodecylbenzenesulfonate, sodium laurylalcohol sulfate, sodium stearate, and like fatty acid alkali metal salts; and perfluoroalkyl ethylene oxide adducts and like fluorosurfactants. Examples of waxes include carnauba wax, paraffin wax, and ester wax. Examples of lubricants include potassium stearyl phosphate and like alkyl phosphates; zinc stearate, calcium stearate, and like fatty acid metal salts; and polyethylene wax. Examples of pigments include kaolin, clay, talc, calcium carbonate, calcined kaolin, titanium oxide, amorphous silica, and aluminum hydroxide. Examples of water resistant additives (crosslinking agents) include glyoxal, formalin, glycine, glycidyl esters, glycidyl ethers, dimethylolurea, ketene dimer, dialdehyde starch, melamine resins, polyamide resins, polyamide-epichlorohydrin resins, ketone-aldehyde resins, borax, boric acid, zirconium ammonium carbonate, epoxy compounds, hydrazine compounds, and oxazoline group-containing compounds.

In the present invention, an intermediate layer containing an aqueous adhesive is formed on the heat-sensitive recording layer to thereby suppress gloss reduction caused by melt softening of the heat-sensitive recording layer due to the heat of the thermal head. The intermediate layer also has barrier properties against ultraviolet- or electron-beam-curable resin compositions, and enhances preservability, such as resistance to background fogging.

Examples of an aqueous adhesive for use in the intermediate layer include aqueous adhesives usable in the heat-sensitive recording layer. Among such aqueous adhesives, various modified polyvinyl alcohols are preferable. To attain excellent film-forming ability and barrier properties, completely saponified polyvinyl alcohol, partially saponified polyvinyl alcohol, silicon-modified polyvinyl alcohol, acetoacetyl-modified polyvinyl alcohol, carboxy-modified polyvinyl alcohol, diacetone-modified polyvinyl alcohol, and casein are particularly preferable. Although not particularly limited, the amount of aqueous adhesive used is preferably about 20 to 80 mass %, based on the total solids content of the intermediate layer, to attain excellent barrier properties and excellent recording sensitivity.

The intermediate layer may further contain various additives usable in the heat-sensitive recording layer. Examples of such additives include surfactants, waxes, lubricants, pigments, and water resistant additives (crosslinking agents).

Examples of pigments include inorganic pigments such as kaolin, clay, aluminum hydroxide, calcined clay, colloidal silica, calcium carbonate, zinc oxide, aluminum oxide, titanium oxide, diatomaceous earth, amorphous silica, barium sulfate, and talc; and organic pigments such as styrene resin fillers, nylon resin fillers, and urea-formaldehyde resin fillers.

The intermediate layer can be formed by applying an intermediate layer coating composition to the heat-sensitive recording layer to a coating thickness of about 1 to 10 g/m$^2$, preferably about 1 to 7 g/m$^2$, more preferably about 2 to 5 g/m$^2$, and still more preferably about 2 to 4 g/m$^2$, on a dry weight basis, and drying the composition. The intermediate layer coating composition can be prepared by mixing and dispersing an aqueous adhesive agent, optionally with additives, such as surfactants, waxes, lubricants, pigments, and water resistant additives (crosslinking agents), in water as a medium. A coating thickness of 1 g/m$^2$ or more enables the formation of a uniform coating film and enhances barrier properties, whereas a coating thickness of 10 g/m$^2$ or less enhances recording sensitivity. Examples of surfactants may be the same as those mentioned as surfactants usable in the heat-sensitive recording layer.

The heat-sensitive recording layer coating composition and the intermediate layer coating composition may be applied in such a manner that the former is applied and dried and then the latter is applied and dried to form one layer after another. Also, the same coating composition may be used to form two or more layers. Alternatively, the coating compositions may be applied all at once to form two or more layers. Examples of coating methods include slot die coating, slide bead coating, curtain coating, air knife coating, blade coating, gravure coating, micro gravure coating, bar coating, rod coating, and roll coating.

After each layer is formed, the layer may be subjected to a smoothing treatment by a known smoothing method, such as supercalendering or soft calendering. This smoothing treatment can further enhance the gloss and recorded image quality. The smoothing treatment may be performed by contacting the surface of the heat-sensitive recording layer side with either a metal roll or an elastic roll. When a plastic film or the like is used as a support, the surface of the support may be subjected to corona discharge, ultraviolet or electron beam irradiation, or like treatment. Such a treatment can enhance suitability for coating with a protective layer to form a protective layer with a uniform thickness, reduce coating defects of the heat-sensitive recording layer, and enhance the adhesion between the support and the heat-sensitive recording layer.

The protective layer in the present invention is cured by irradiating an ultraviolet- or electron-beam-curable coating composition with ultraviolet light or an electron beam. As a result, a heat-sensitive recording material can be obtained, wherein the surface of the uppermost layer has a gloss at 75° of not less than 90%, and preferably 93% or more, and a gloss at 20° of not less than 35%, and preferably 45% or more, in accordance with JIS P 8142-1993.

Examples of resin used in the ultraviolet- or electron-beam-curable coating composition include prepolymers and monomers. Examples of prepolymers include (a) poly(meth) acrylates of aliphatic, alicyclic, aromatic-aliphatic, dihydric to hexahydric alcohols and polyalkylene glycols; (b) poly (meth)acrylates of polyhydric alcohols which are alkylene oxide adducts of aliphatic, alicyclic, aroma-aliphatic, or aromatic, dihydric to hexavalent alcohols, (c) poly(meth)acryloyloxyalkyl phosphates; (d) polyester poly(meth)acrylates; (e) epoxy poly(meth)acrylates; (f) polyurethane poly(meth) acrylates; (g) polyamide poly(meth)acrylates, (h) polysiloxane poly(meth)acrylates; (i) vinyl or diene low polymers having a (meth)acryloyloxy group at a side chain and/or terminal thereof; (j) modified products of the compounds (a) to (i) with an oligoester (meth)acrylate.

Examples of monomers include (a) carboxy-containing monomers such as ethylenically unsaturated mono- or polycarboxylic acids, and carboxylate group-containing monomers such as alkali metal salts, ammonium salts, and amine salts thereof; (b) amide group-containing monomers such as ethylenically unsaturated (meth)acrylamides or alkyl substituted (meth)acrylamides, and vinyl lactams (e.g., N-vinylpyrrolidone); (c) sulfonic acid group-containing monomers such as aliphatic or aromatic vinylsulfonic acids, and sulfonic acid salt group-containing monomers such as alkali metal, ammonium, and amine salts thereof; (d) hydroxy-containing monomers such as ethylenically unsaturated ethers; (e) amino group-containing monomers such as dimethylaminoethyl (meth)acrylate-2-vinylpyridine; (f) quaternary ammonium salt group-containing monomers; (g) alkyl esters of ethylenically unsaturated carboxylic acids; (h) nitrile group-containing monomers such as methacryronitrile; (i) styrene; (j) ethylenically unsaturated alcohol esters such as vinyl acetate and (meth)allyl acetate; (k) mono(meth)acrylates of alkylene oxide adducts of active hydrogen-containing compounds; (l) ester-containing bifunctional monomers such as diesters of a polybasic acid and an unsaturated alcohol; (m) bifunctional monomers comprising a diester of (meth)acrylic acid and an alkylene oxide-adduct polymer of an active hydrogen-containing compound; (n) bisacrylamides such as N,N-methylenebisacrylamide; (o) bifunctional monomers such as divinylbenzene, divinyl ethylene glycol, divinylsulfone, divinyl ether, and divinyl ketone; (p) ester-containing polyfunctional monomers such as polyesters of a polycarboxylic acid and an unsaturated alcohol; (q) polyfunctional monomers comprising a polyester of (meth)acrylic acid and an alkylene oxide adduct polymer of an active hydrogen-containing compound; (r) polyfunctional unsaturated polymers such as trivinylbenzene; and (s) esters of an active hydrogen-containing ester compound and (meth)acrylic acid. Such prepolymers and monomers can be used singly or in a combination of two or more. Among these, esters of an active hydrogen-containing ester compound and (meth)acrylic acid are preferable. To enhance fracture resistance, esters of (meth)acrylic acid and an ester of a hydroxy-containing carboxylic acid and alkylene glycol are more preferable. Diesters of (meth)acrylic acid and an ester of a hydroxy-containing carboxylic acid and alkylene glycol are even more preferable. More specifically, it is particularly preferable to use neopentylglycol hydroxypivalate diacrylate as a main component. The "main component" as used herein refers to a component whose content is one of the highest in the composition. For a composition consisting of two components, it means a component whose content is about 50 mass % or more in the composition. The term "(meth)acrylic acid" refers to "methacrylic acid" and/or "acrylic acid."

The average thickness of the cured protective layer is preferably about 0.5 μm or more, and 5 μm or less. An average thickness of 0.5 μm or more can provide a high gloss, and enables suitable adjustment of the protective layer surface to a gloss at 75° of 90% or more, and the uppermost layer surface to a gloss at 75° of 90% or more and a gloss at 20° of 35% or more, according to JIS P 8142-1993. On the other hand, an average thickness of 5 μm or less can provide excellent fracture resistance, i.e., resistance to so-called "bending cracks," i.e., cracks formed on the recording surface when the heat-sensitive recording material is bent. Furthermore, sebum soiling scratch off properties can be enhanced. The average thickness is more preferably about 1.0 to 4 μm. The average thickness of the protective layer is determined by using an electron microscope to take a reflection electron compositional image of a cross section of the heat-sensitive recording material at a magnification of 1,000× to 3,000×, then measuring the thickness at five arbitrary points in the image, and obtaining the average value of three points among the five arbitrary points, excluding the maximum and minimum. More simply, the average thickness may be calculated by the following formula: the solids content of the protective layer is divided by the density of the cured protective layer.

The protective layer of the present invention preferably contains a filler. The use of a filler can inhibit the so-called "sticking phenomenon" caused by thermal fusion of the heat-sensitive recording material surface to a thermal head, and enhance scratch off properties against sebum soiling sticking to the thermal head surface. To enhance gloss, the average thickness of the protective layer is preferably not less than the mean particle diameter of the filler.

The shape of the filler is preferably such that the primary particle is spherical or quasi-spherical. More specifically, spherical, spindle-shaped, cubic, rectangular, hexagonal columnar, spiky-shaped, and amorphous fillers are preferable to increase the scratch off effect for removing smudges from the thermal head. Such fillers can be used singly or in a combination of two or more. Insofar as the effect of the present invention is not impaired, plate-like, needle-like, rod-like, flat or other shaped fillers may be incorporated.

Specific examples of fillers include kaolin, calcined kaolin, calcium carbonate, barium carbonate, zinc carbonate, zinc oxide, aluminum oxide, titanium dioxide, silicon dioxide, aluminum hydroxide, barium sulfate, zinc sulfate, calcium silicate, talc, amorphous silica, spherical silica, alumina, diatomaceous earth, calcined diatomaceous earth, mica, magnesium oxide, magnesium carbonate, aluminosilicate, activated clay, montmorillonite, synthetic zeolite, colloidal silica, and like inorganic pigments; such inorganic pigments surface-treated with an organic acid; carbon black, polyolefin resins, polystyrene resins, polyester resins, polyamide resins, urea resins, acrylic resins, melamine resins, benzoguanamine resins, epoxy resins, fluororesins, wheat flour, starches, other organic pigments, and like microparticles; porous fine particles, hollow fine particles, and like organic pigments.

Among these, cubic synthetic zeolite and spherical silica are preferable to enhance gloss and recorded image quality.

The filler content is preferably 1 to 15 mass %, and more preferably 2 to 12 mass %, based on the total solids content of the protective layer. A filler content of 1 mass % or more inhibits sticking and remarkably enhances sebum soiling scratch off properties. A filler content of not more than 15 mass % can increase gloss and enables suitable adjustment of the protective layer surface to a gloss at 75° of 90% or more according to JIS P 8142-1993, and the uppermost layer surface to a gloss at 75° of 90% or more and a gloss at 20° of 35% or more. Furthermore, a filler content of not more than 15 mass % can also enhance recorded image quality and fracture resistance.

In the present invention, the filler preferably has a 50% mean volume particle diameter (D50) of less than 2.0 μm as determined from the cumulative volume distribution, and a ratio of the 90% mean volume particle diameter (D90) to the 50% mean volume particle diameter (D50) (D90/D50) of not more than 3.0. The use of a filler with such a diameter can enhance gloss and recorded image quality.

The mean particle diameter of the filler used in the protective layer can be measured by a laser diffraction light-scattering method (using the SALD-2200 produced by Shimadzu Corporation, the LB-500 produced by Horiba, Ltd., the MT3300 produced by Nikkiso Co., Ltd., etc.); the centrifugal sedimentation method; or using a commonly used particle size analyzer, such as a Coulter counter or an electron microscope.

The protective layer can be formed, for example, by applying a protective layer coating composition to the intermediate layer. The protective layer coating composition is prepared by mixing, for example, a ultraviolet- or electron-beam-curable resin, optionally with a filler, using an appropriate mixing agitator, such as a three-roll mill or a mixer. Prior to the application of the protective layer coating composition, the intermediate layer surface may be subjected to corona discharge treatment, etc., in order to increase the adhesion between the intermediate layer and the protective layer. Examples of usable coating methods include offset gravure coating, air knife coating, Meyer bar coating; blade coating, reverse roll coating, slit die coating, and like various known coating methods. Insofar as the effect of the present invention is not impaired, the protective layer coating composition may further contain resins other than the ultraviolet- or electron-beam-curable resin, such as an acrylic resin, a silicon resin, an alkyd resin, a fluororesin, and a butyral resin; and additives such as an antifoaming agent, a leveling agent, a lubricant, a surfactant, a plasticizer, a ultraviolet absorber, a fluorescent dye, a color dye, a fluorescent pigment, and a color pigment. Further, to prevent sticking, zinc stearate, etc., may be added as a lubricant.

When ultraviolet radiation is used for curing, a photoinitiator contained in the ultraviolet- or electron-beam-curable resin composition can promote the curing. The photoinitiator that can be used is not particularly limited, and various known photoinitiators may be used. Examples of usable photoinitiators include methyl benzoyl benzoate, benzoin, benzyl dimethyl ketal, diethoxyacetophenone, 2-hydroxy-2-methyl-1-phenyl-1-propanone, 2-methyl-1-[4-(methylthio)phenyl]-2-morpholino-1-propanone, 1-hydroxycyclohexylphenylketone, 2,4-diethylthioxanthone, 2,4,6-trimethylbenzoyldiphenylphosphine oxide, bis(2,4,6-trimethylbenzoyl)-phenylphosphine oxide, camphorquinone, anthracene, benzyl, and phenylmethyl glyoxylate. Such photoinitiators can be used singly or in a combination of two or more.

The photoinitiator content is preferably about 0.05 to 10 parts by mass, and more preferably about 0.1 to 5 parts by mass, based on 100 parts by mass of the ultraviolet- or electron-beam-curable resin. A photoinitiator content of 0.05 part by mass or more can effectively promote curing. On the other hand, if the photoinitiator content is more than 10 parts by mass, curing is saturated. Accordingly, a photoinitiator content of 10 parts by mass or less can reduce the production cost.

In the present invention, the protective layer preferably has a Martens hardness of 100 to 200 N/mm$^2$ according to ISO 14577. This can be achieved by adjusting the number of reactive functional groups, molecular weight, etc., of the ultraviolet- or electron-beam-curable resin contained in the protective layer and thereby adjusting the cross-linking density. A Martens hardness of 100 N/mm$^2$ or more can inhibit sticking, and enhance the sebum soiling scratch off property; furthermore, it can prevent gloss reduction by making it difficult to form scratches on the protective surface when the uppermost layer coating composition is applied. On the other hand, a Martens hardness of 200 N/mm$^2$ or less provides excellent fracture resistance.

In the present invention, when ultraviolet radiation is used for curing, the light source for ultraviolet radiation may be, for example, 1 to 50 UV lamps, xenon lamps, tungsten lamps, etc. Ultraviolet light with an intensity of about 40 to 240 W/cm, and preferably about 60 to 180 W/cm, can be thereby irradiated. When an electron beam is used, the absorbed dose of the electron beam is 10 to 200 kGy, and preferably 20 to 100 kGy. An absorbed dose of 10 kGy or more can sufficiently cure the resin component. An absorbed dose of 200 kGy or less will not cause coloring or discoloration of the heat-sensitive recording material due to excessive electron beam irradiation. Examples of electron beam irradiation methods include a scanning method, a curtain beam method, and a broad beam method. The electron beam is applied at an accelerating voltage of about 70 to 300 kV. Ultraviolet and electron beams may be applied from either the recording surface side or the back side of the support. The irradiation conditions may be suitably selected according to the composition and amount of ultraviolet- or electron-beam-curable resin applied. To enhance gloss, curing by electron beam irradiation is preferable.

In the present invention, an uppermost layer containing an aqueous adhesive and a pigment having a mean particle diameter of 100 nm or less is formed on the protective layer. Based on this structure, a heat-sensitive recording material comprising a uniform, thin uppermost layer and a protective layer having a high gloss surface that has excellent absorption and scratch off properties against sebum soiling can be obtained.

Examples of aqueous adhesives that can be used in the uppermost layer include those that can be used in the heat-sensitive recording layer. Such aqueous adhesives can be used singly or in a combination of two or more. The total aqueous adhesive content is preferably 20 to 70 mass %, based on the total solids content of the uppermost layer. When the aqueous adhesive content is 20 mass % or more, a uniform thin layer with excellent film-forming ability can be formed. When the aqueous adhesive content is 70 mass % or less, an excellent sticking resistance effect can be provided.

Other examples of aqueous adhesives that can be used in the uppermost layer include aqueous adhesives such as a water-dispersible adhesive and a water-soluble adhesive. Examples of water-soluble adhesives include starch, hydroxyethylcellulose, methylcellulose, carboxymethyl cellulose, gelatin, casein, gum arabic, completely saponified polyvinyl alcohol, partially saponified polyvinyl alcohol, silicon-modified polyvinyl alcohol, acetoacetyl-modified polyvinyl alcohol, carboxy-modified polyvinyl alcohol, diacetone-modified polyvinyl alcohol, diisobutylene-maleic anhydride copolymer salt, styrene-maleic anhydride copolymer salt, ethylene-acrylic acid copolymer salt, styrene-acrylic acid copolymer salt, methyl vinyl ether-maleic anhydride copolymer salt, isopropylene-maleic anhydride copolymer salt, and polyacrylamide. Examples of water-dispersible adhesives include vinyl acetate latex, styrene-butadiene latex, acrylic latex, and urethane latex. Among these, water-dispersible adhesives, such as vinyl acetate latex, styrene-butadiene latex, acrylic latex, and urethane latex, are preferable to increase the adhesion to the protective layer cured by irradiation of the ultraviolet- or electron-beam-curable resin composition with ultraviolet light or an electron beam.

The uppermost layer preferably contains, in addition to an aqueous adhesive as mentioned above, an aqueous adhesive containing a polyurethane ionomer. Such an aqueous adhesive can provide excellent film-forming ability and enables the formation of a uniform uppermost layer, thus increasing gloss and adhesion between the protective layer and the uppermost layer and enhancing water resistance. Furthermore, an excellent sticking resistance effect can be provided. The aqueous adhesive content is preferably 20 to 60 mass %, and more preferably 30 to 50 mass %, based on the total solids content of the uppermost layer. An aqueous adhesive content of 20 mass % or more can increase the adhesion between the uppermost layer and the protective layer, and inhibit components from being released from the uppermost layer and sticking to and remaining on the thermal head. An aqueous adhesive content of 20 mass % or more can also enhance water resistance. On the other hand, an aqueous adhesive content of 60 mass % or more can effectively suppress sticking.

The polyurethane-ionomer-containing aqueous adhesive used in the present invention is different from conventional emulsion-type adhesives that are prepared by dispersing a polyurethane resin in water using an emulsifying agent, etc. The polyurethane-ionomer-containing aqueous adhesive of the invention is a so-called colloidal dispersion-type urethane resin prepared by dissolving or finely dispersing an ionic urethane resin, i.e., a polyurethane ionomer, based on ionic groups of the polyurethane ionomer, in water without the necessity of using an emulsifying agent or an organic solvent. Specific examples of polyurethane-ionomer-containing aqueous adhesives include commercially available products, such as HYDRAN (registered trademark), AP-40, AP-30, and AP-20, all produced by DIC Corporation, and the Superflex series manufactured by Dai-ichi Kogyo Seiyaku Co., Ltd., which can all be easily obtained and used.

Further, the uppermost layer of the present invention preferably contains a resin obtained from an aqueous adhesive, which is a polymer latex having a heterogeneous particle structure containing a urethane resin component in at least one phase. The adhesion between the uppermost layer and the protective layer can be thereby increased. The aqueous adhesive content is preferably 5 to 30 mass %, and more preferably 5 to 20 mass %, based on the total solids content of the uppermost layer. An aqueous adhesive content of 5 mass % or more can increase the adhesion between the uppermost layer and the protective layer. On the other hand, an aqueous adhesive content of 30 mass % or less can provide an excellent sticking resistance effect.

The polymer latex having a heterogeneous particle structure is not particularly limited in the structure. Examples of heterogeneous particle structures and production methods therefor are described in "Application of Synthetic Latex (edited by Takaaki SUGIYAMA, Yasuo KATAOKA, Soichi SUZUKI, Keiji KASAHARA; and published by Kobunshi Kankokai Inc., (1993))". Examples of heterogeneous particle structures include a core-shell structure, a composite structure, a localized structure, a potbellied structure, a raspberry-like structure, a multiparticle composite structure, a crescent-shaped structure, and an IPN (interpenetrating network). In the present invention, polymer latexes having a core-shell structure, a composite structure, a raspberry-like structure, or a multiparticle composite structure are preferable.

The polymer latex having a heterogeneous particle structure containing a urethane resin component in at least one phase may contain components other than the urethane resin. Examples of such components include natural rubber, polybutadiene, a styrene-butadiene polymer, an acrylonitrile-butadiene polymer, a methyl methacrylate-butadiene polymer, polyacrylonitrile, polyvinyl acetate, polyethyl acrylate, polybutyl acrylate, polymethylmethacrylate, and polyvinyl chloride. Among these, polymer latexes containing a styrene-butadiene polymer, an acrylonitrile-butadiene polymer, or a methyl methacrylate-butadiene polymer are preferable. In particular, latexes obtained by polymerizing a styrene monomer and a butadiene monomer in an aqueous medium containing a polyurethane ionomer as a urethane resin component are preferable. The urethane resin content of the polymer latex having a heterogeneous particle structure containing a urethane resin component in at least one phase is preferably 3 to 90 mass %, and more preferably 20 to 80 mass %. Specific examples of the polymer latex having a heterogeneous particle structure containing a urethane resin component in at least one phase include commercially available products, such as Pateracol (registered trademark) H2090 and H2020A (produced by DIC Corporation), which can be easily obtained and used.

When the polymer latex having a heterogeneous particle structure containing a urethane resin component in at least one phase is used with an aqueous adhesive containing a polyurethane ionomer, the polymer latex is preferably used in an amount of about 10 to 60 parts by mass, and more preferably about 10 to 55 parts by mass, per 100 parts by mass of the aqueous adhesive containing a polyurethane ionomer. A polymer latex content of 10 parts by mass or more can increase the adhesion between the uppermost layer and the protective layer. On the other hand, a polymer latex content of 60 parts by mass or less can provide an excellent sticking resistance effect.

According to the present invention, the uppermost layer contains a pigment with a mean particle diameter of 100 nm or less. Therefore, dust or foreign matter adhering to the surface of the heat-sensitive recording material, particularly sebum soiling, etc., that adheres when the surface is touched with a bare hand, can be adsorbed thereon without gloss reduction, and the transfer of sebum soiling, etc. to the thermal head surface during recording can be prevented. Furthermore, even when sebum soiling, etc., is transferred to the thermal head surface, sebum soiling, etc., is adsorbed and easily scratched off of the thermal head during recording. Particularly, in the present invention, since the protective layer surface is highly hydrophobic and has a low wetting tension, an uppermost thin layer formed thereon would normally be expected to have problems such as cissing and uneven coating of pigment with a mean particle diameter of 100 nm or less. However, a uniform uppermost layer with excellent film-forming ability can be formed, thus reducing printing failures such as scratches and white streaks, which are caused by the accumulation of sebum soiling, etc., on the thermal head surface.

The pigment contained in the uppermost layer has a mean particle diameter of 100 nm or less, preferably 80 nm or less, and more preferably 50 nm or less. A mean particle diameter of more than 100 nm may impair high gloss in the protective layer surface and reduce the gloss of the uppermost layer-side surface, thus resulting in a loss of quality in the recorded image. Although the lower limit of the mean particle diameter is not particularly limited, it is usually about 5 nm or more because commercially available pigments for industrial use have such a mean particle diameter. A particle size of less than 5 nm may impair the stability of the particles and form secondary aggregates, etc., thus resulting in a loss of quality in the recorded image.

The mean particle diameter of the pigment used in the uppermost layer can be measured, for example, by using a commonly used measuring apparatus, such as s laser diffraction-light scattering particle size analyzer (the SALD-2200 produced by Shimadzu Corporation Corp., the LB-500 produced by Horiba, Ltd., the MT3300 produced by Nikkiso Co., Ltd.), a centrifugal sedimentation system, a Coulter counter, an electron microscope, etc.

Examples of the pigment include mica, hectorite, smectite, and like layered silicate compounds; and colloidal silica, alumina sol, zinc oxide, titanium oxide, and like inorganic pigment particles. Among these, layered silicate compounds and colloidal silica are preferable because they can adsorb sebum soiling, etc., adhering to the surface of the heat-sensitive recording material, and have an excellent effect of inhibiting residues from depositing on the thermal head surface. Among the layered silicate compounds, synthetic hectorite is particularly preferable.

The pigment content is preferably 20 to 70 mass %, and more preferably 20 to 60 mass %, based on the total solids content of the uppermost layer. A pigment content of 20 mass % or more can enhance sebum soiling absorption and scratch off properties. On the other hand, a pigment content of 70 mass % or less can enhance gloss and the quality of the recorded image.

The pigment content is preferably 45 to 180 parts by mass, and more preferably 45 to 160 parts by mass, per 100 parts by mass of the total amount of aqueous adhesives used in the uppermost layer. A pigment content of 45 parts by mass or more can enhance sebum soiling absorption and scratch off properties. On the other hand, a pigment content of 180 parts by mass or less can enhance gloss and the quality of the recorded image.

When the uppermost layer contains an aqueous adhesive containing a polyurethane ionomer, the pigment content is preferably 50 to 200 parts by mass, and more preferably 60 to 190 parts by mass, per 100 parts by mass of the aqueous adhesive containing a polyurethane ionomer. A pigment content of 50 parts by mass or more can enhance sebum soiling absorption and scratch off properties. On the other hand, a pigment content of 200 parts by mass or less can enhance gloss and the quality of the recorded image, and can increase the adhesion between the uppermost layer and the protective layer.

The uppermost layer is preferably formed by applying an uppermost layer coating composition to the protective layer and drying the composition. The uppermost layer coating composition is prepared, for example, by mixing, in addition to the pigment and aqueous adhesive, other additives such as alkyl phosphate, alkali metal pyrophosphate, and a specific thickener into water, which serves as a medium.

As the thickener, at least one member selected from the group consisting of acrylic alkali thickeners, polyethylene oxide, xanthan gum, and sodium polyacrylate can be used.

In the present invention, the surface of the protective layer is highly hydrophobic and has a low wetting tension. Accordingly, a specific thickener is incorporated in the uppermost layer coating composition to suppress cissing and uneven dryness of the coating composition due to non-uniform flow during drying. Further, an alkali metal pyrophosphate is incorporated to suppress thickening of the coating composition over time caused by the specific thickener and to reduce uneven coating, thereby forming a uniform thin uppermost layer to enhance the quality of the recorded image and gloss. Further, an alkyl phosphate and a pigment having a mean particle diameter of 100 nm or less are incorporated to provide excellent running performance in the recording.

The content of alkyl phosphate, such as potassium stearyl phosphate, is preferably 0.5 to 10 mass %, more preferably 0.5 to 8 mass %, and even more preferably 1 to 5 mass %, based on the total solids content of the uppermost layer. An alkyl phosphate content of 0.5 mass % or more can reduce the adhesion between the thermal head and the uppermost layer, and effectively inhibit the formation of printing scratches in a high humidity environment, for example, at 30° C. and 85% RH. On the other hand, an alkyl phosphate content of 10 mass % or less can suppress the uppermost layer coating composition from thickening over time and reduce uneven coating.

In the present invention, to form a thin uppermost layer, an uppermost layer coating composition with a low solids content may be prepared by a process wherein a specific thickener is used to adjust the viscosity of the coating composition to an appropriate level, while an increase in the viscosity of the coating composition before drying with a dryer is kept low. Even in this case, quick viscosity increase upon drying with a dryer can control the flow of the coating composition and suppress uneven dryness to reduce small printing irregularities in recorded portions and enhance the quality of the recorded image.

The acrylic alkali thickener used as such a thickener contains a non-crosslinked alkali-soluble emulsion or a crosslinked alkali swellable emulsion as a main component of the acrylic polymer. When an alkali such as aqueous ammonia or sodium hydroxide is added, such a non-crosslinked alkali-soluble emulsion or crosslinked alkali swellable emulsion dissolves or swells, and can increase the viscosity of the coating composition, based on a chemical bonding (a hydrogen bond) action between the polymer and water molecules, or a physical action of the polymer containing water molecules. In particular, such an acrylic thickener is of an emulsion type and thus has a relatively high solids content; therefore, a small amount of such a thickener can provide a sufficient thickening effect. Accordingly, the degree of water resistance impairment by such an acrylic thickener is much lower than that of a commonly used thickener, such as carboxymethyl cellulose, methylcellulose, or sodium alginate.

Polyethylene oxide preferably has a viscosity-average molecular weight of 100,000 or more, and more preferably 500,000 or more to efficiently increase the viscosity of the coating composition. The viscosity-average molecular weight of polyethylene oxide is preferably 5,000,000 or less to enhance miscibility in the coating solution.

The term "xanthan gum" as used herein refers to gum extracellularly produced by *Xanthomonas campestris*, i.e., a heteropolysaccharide-producing bacterium, by culturing in a medium containing fermentative carbohydrate, a nitrogen source, and other suitable nutrient sources under various conditions. U.S. Pat. No. 4,316,012 discloses xanthan gum. Specific examples of xanthan gums include the commercially available KELZAN series produced by Sansho Co., Ltd., which can be easily obtained and used.

When an acrylic alkali thickener is used, the thickener content is preferably in the range of 0.1 to 3 mass %, and more preferably 0.1 to 2 mass %, based on the total solids content of the uppermost layer. When one member selected from the group consisting of polyethylene oxide, xanthan gum, and sodium polyacrylate is used as the thickener, the thickener content is preferably 0.05 to 0.5 mass %, and more preferably 0.05 to 0.4 mass %, based on the total solids content of the uppermost layer. The use of such a thickener in an amount within a suitable range can effectively suppress uneven dryness and uneven coating caused by thickening over time, and enables unrecorded portions on the uppermost layer surface to have a gloss at 20° of preferably 55% or more, and more preferably 65% or more, whereby a gloss closer to a mirror gloss can be attained, thus enhancing the quality of the recorded image. Furthermore, the use of such a thickener in an amount within a suitable range also allows water resistance to be enhanced. When such thickeners are used in combination, the secondary thickener is preferably used in an amount of 20 mass % or less, based on the primary thickener.

According to the present invention, the uppermost layer coating composition contains an alkali metal pyrophosphate, such as sodium pyrophosphate, thereby enhancing the stability of the coating composition and suppressing the thickening of the coating composition over time, thus reducing uneven coating. Particularly, when a layered silicate compound is used as a pigment in the uppermost layer, the pigment is used in the form of a dispersion in water as a medium to produce an uppermost layer coating composition, and thus can exhibit excellent stability as a dispersant.

The alkali metal pyrophosphate content is in the range of 3 to 20 mass %, and preferably 5 to 15 mass %, based on the pigment in the uppermost layer. An alkali metal pyrophosphate content of 3 mass % or more can suppress the thickening of the coating composition over time and can reduce uneven coating. On the other hand, an alkali metal pyrophosphate content of 20 mass % or less can enhance water resistance.

Further, the uppermost layer may optionally contain additives, such as a surfactant, a wax, a lubricant, a water resistant additive (crosslinking agent), an antifoaming agent, a fluorescent dye, and a color dye. Examples of surfactants include fatty acid alkali metal salts, such as sodium dioctylsulfosuccinate, sodium dodecylbenzenesulfonate, sodium laurylalcohol sulfate, and sodium stearate; and fluorosurfactants such as perfluoroalkyl ethylene oxide adducts. Examples of waxes include carnauba wax, paraffin wax, and ester wax. Examples of lubricants include alkyl phosphates such as potassium stearyl phosphate; fatty acid metal salts such as, zinc stearate, and calcium stearate; and polyethylene wax. To improve the running performance in the recording, the uppermost layer preferably contains zinc stearate in an amount of about 1 to 20 mass %, and more preferably about 5 to 10 mass %, based on the total solids content of the uppermost layer. In particular, an emulsified dispersion of zinc stearate having a small mean particle diameter is preferable as a lubricant. Examples of water resistant additives include glyoxal, formalin, glycine, glycidyl esters, glycidyl ethers, dimethylolurea, ketene dimer, dialdehyde starch, melamine resins, polyamide resins, polyamide-epichlorohydrin resins, ketone-aldehyde resins, borax, boric acid, zirconium carbonic acid ammonium, epoxy compounds, hydrazine compounds, and oxazoline group-containing compounds.

The uppermost layer can be formed by applying an uppermost layer coating composition to the protective layer and drying the composition. The uppermost layer coating composition can be produced by mixing an aqueous adhesive and a pigment having a mean particle diameter of 100 nm or less, optionally with additives, etc., in water, which serves as a medium.

The amount of the uppermost layer coating composition to be applied is not particularly limited. The composition is preferably applied to an average thickness of 0.02 to 0.4 μm, and more preferably 0.05 to 0.35 μm, on a dry film basis, which must be a thickness not less than the mean particle diameter of the pigment used in the uppermost layer. An average thickness of 0.02 μm or more can prevent coating defects, and enhance sebum soiling absorption properties. In contrast, a thin film having a thickness of 0.4 μm or less can inhibit formation of an interference fringe pattern (iridescent mottling) on the uppermost layer, which is prominently observed in films having a thickness of more than 0.4 μm, thus enhancing the recording surface quality. Furthermore, controlling the average thickness of the uppermost layer to a value not less than the mean particle diameter of the pigment can enhance gloss and the quality of the recorded image. The average thickness of the uppermost layer is determined by using an electron microscope to take a reflection electron compositional image of a cross section of the heat-sensitive recording material at a magnification of 1,000× to 3,000×, then measuring the thickness at five arbitrary points in the image, and obtaining the average value of three points among the five arbitrary points, excluding the maximum and minimum. More simply, the average thickness may be calculated by the following formula: the solids content of the uppermost layer coating composition to be applied is divided by the density of the dried uppermost layer.

The uppermost layer coating composition is applied to the protective layer by a coating method, such as slot die coating, slide bead coating, curtain coating, air knife coating, blade coating, gravure coating, micro gravure coating, bar coating, rod coating, or roll coating. Among these, micro gravure coating is preferable as a coating method to suppress uneven flow of the coating and to form a uniform thin film that is free of coating defects such as cissing and that has an uppermost layer with an average thickness of 0.02 to 0.4 μm. Examples of micro gravure coating methods include one disclosed in Japanese Unexamined Patent Publication No. H2-119977. According to the present invention, the uppermost layer is formed by applying the coating composition to the protective layer and drying the composition; therefore, it is unnecessary to perform complicated steps, for example, applying a coating composition to a base material different from the support and drying the composition to form an uppermost layer and then transferring the obtained uppermost layer to the support side. Thus, productivity can be increased by a simple method.

According to the present invention, after forming a protective layer and before applying the uppermost layer coating composition, the surface of the protective layer may be subjected to corona discharge, electron beam or ultraviolet irradiation, or a like treatment to increase the wetting tension of the protective layer surface to 50 mN/m or more. This irradiation can effectively form a uniform uppermost layer free of coating defects, and enhance the quality of the recorded image. Modification by surface treatment is also effective for increasing the adhesion between the protective layer and the uppermost layer. The wetting tension is measured according to the test method of JIS K 6768-1999.

To improve running performance in the recording and prevent static adhesion and thermal head damage, the heat-sensitive recording material of the present invention may further comprise a back layer formed by applying a back layer coating composition to the back surface of the support. The back layer coating composition contains a pigment, an adhesive, an antistatic agent, etc. Further, various techniques known in the field of manufacturing heat-sensitive recording materials may be applied as required.

EXAMPLES

The present invention is explained in more detail below in reference to Examples. The present invention is, however, not limited to these Examples. In the explanation below, "part" means "part by mass" and "%" means "mass %," unless otherwise specified. To determine the mean particle diameter of the respective leuco dye and respective developer used in the Examples and Comparative Examples, the mean volume diameter thereof was measured using a SALD-2200 laser diffraction particle size analyzer (produced by Shimadzu Corporation). To determine the mean particle diameter of the filler used for the protective layer, the mean volume diameter thereof was measured using an MT3300 microtrac particle size distribution analyzer (produced by Nikkiso Co., Ltd.). Furthermore, the mean particle diameter of the pigment used in the uppermost layer was determined by measuring the mean volume diameter thereof using an LB-500 dynamic light-scattering particle size analyzer (produced by Horiba, Ltd.). The Martens hardness was measured on the surface of the cured protective layer before forming the uppermost layer thereon using an ultra-micro hardness tester (product name: Fischerscope HM2000, produced by Fischer Instruments K.K.).

Example 1

Preparation of Leuco Dye Dispersion (Dispersion A)

A composition comprising 20 parts of 3-di(n-butyl)amino-6-methyl-7-anilinofluoran, 10 parts of a 10% aqueous solution of sulfone-modified polyvinyl alcohol (product name: Gohseran L-3266, produced by Nippon Synthetic Chemical Industry Co., Ltd.), and 20 parts of water was dispersed using a sand mill to obtain Dispersion A having a mean volume diameter of 1.0 μm.

Preparation of Developer Dispersion (Dispersion B)

A composition comprising 50 parts of 4-hydroxy-4'-isopropoxydiphenylsulfone, 20 parts of a 10% aqueous solution of sulfone-modified polyvinyl alcohol (product name: Gohseran L-3266, produced by Nippon Synthetic Chemical Industry Co., Ltd.), and 60 parts of water was dispersed using a sand mill to obtain Dispersion B having a mean volume diameter of 1.3 μm.

Preparation of Heat-Sensitive Recording Layer Coating Composition

A composition comprising 70 parts of Dispersion A, 75 parts of Dispersion B, 40 parts of a 25% slurry of amorphous silica (product name: Nipsil E-743, produced by Nippon Silica Industrial Co., Ltd.), 50 parts of a 10% aqueous solution of completely saponificated polyvinyl alcohol (product name: PVA105, produced by Kuraray Co., Ltd.), 30 parts of a styrene-butadiene-based latex (product name: L-1571, solids content: 48%, produced by Asahi Kasei Corporation), 20 parts of stearamide (product name: Hymicron L-271, solids content: 25%, produced by Chukyo Yushi Co., Ltd.), and 30 parts of water were mixed to obtain a heat-sensitive recording layer coating composition.

Preparation of Intermediate Layer Coating Composition

A composition comprising 70 parts of a 60% slurry of kaolin (product name: UW-90, produced by Engelhard Corporation), 180 parts of a 10% aqueous solution of acetoacetyl-modified polyvinyl alcohol (product name: Gohsefimer (registered trademark) Z-200, produced by Nippon Synthetic Chemical Industry Co., Ltd.), 2 parts of a 10% aqueous solution of sodium dioctyl sulfosuccinate, and 150 parts of water were mixed to obtain an intermediate layer coating composition.

Preparation of Protective Layer Coating Composition

A composition comprising 60 parts of neopentylglycol hydroxypivalate diacrylate (product name: KAYARAD MANDA, produced by Nippon Kayaku Co., Ltd.) as an electron-beam-curable resin and 40 parts of caprolactone-modified dipentaerythritol hexaacrylate (product name: KAYARAD DPCA-60, produced by Nippon Kayaku Co., Ltd.) was mixed with 5 parts of cubic synthetic zeolite (product name: SILTON AMT-08L, produced by Mizusawa Industrial Chemicals, Ltd.) having a 50% mean volume diameter (D50) of 1.0 μm and 90% mean volume diameter (D90) of 2.0 μm, and 1 part of fine powder of zinc stearate having a 50% mean volume diameter (D50) of 0.7 μm. The resulting mixture was dispersed using a three roll mill to obtain a protective layer coating composition.

Preparation of Synthetic Hectorite Dispersion 4 parts of sodium pyrophosphate was dissolved in 2,600 parts of water and 50 parts of synthetic hectorite (product name: Laponite B, produced by Rockwood, Inc., mean volume diameter: 40 nm) was added thereto. The resulting mixture was stirred vigorously to obtain a synthetic hectorite dispersion.

Preparation of Uppermost Layer Coating Composition

A composition comprising 270 parts of the synthetic hectorite dispersion, 25 parts of an aqueous adhesive (product name: Hydran (registered trademark) AP-40, solids content: 22.5%, produced by DIC Corporation) consisting of a polyurethane ionomer, 1.5 parts of a latex (product name: Patelacol (registered trademark) H2020A, solids content: 41%, produced by DIC Corporation) prepared by polymerizing a styrene monomer and a butadiene monomer in an aqueous medium containing a polyurethane ionomer, and 2 parts of zinc stearate (product name: Hymicron L-111, solids content: 20%, produced by Chukyo Yushi Co., Ltd.) were mixed to obtain an uppermost layer coating composition.

Preparation of Heat-Sensitive Recording Material

The heat-sensitive recording layer coating composition and the intermediate layer coating composition were sequentially applied to one surface of a synthetic paper (product name: YUPO FPG-80, produced by YUPO Corporation) that served as a support in respective amounts of 6.0 g/m$^2$ and 2.5 g/m$^2$ on a dry basis, by a bar coating method and then dried to form a heat-sensitive recording layer and an intermediate layer. After supercalendering the intermediate layer, the protective layer coating composition was applied by offset gravure coating to the upper surface of the intermediate layer in an amount of 1.5 g/m$^2$ on a solids basis. A protective layer was formed by curing the protective layer coating composition with an electro-curtain type electron beam accelerator (produced by Energy Sciences, Inc.) using the irradiation of an electron beam with an accelerating voltage of 175 kV and an absorbed dose of 40 kGy. Thereafter, the surface of the protective layer was subjected to a corona discharge treatment to adjust the wetting tension to 70 mN/m. Subsequently, the uppermost layer coating composition was applied by microgravure coating to the upper surface of the protective layer in an amount of 0.15 g/m$^2$ on a dry basis and then dried to form an uppermost layer, thereby obtaining a heat-sensitive recording material. The protective layer had an average thickness of 1.5 μm, and the uppermost layer had an average thickness of 0.15 μm. The Martens hardness after the formation of the protective layer was 160 N/mm$^2$.

Example 2

A heat-sensitive recording material was produced in the same manner as in Example 1 except that 300 parts of synthetic hectorite dispersion, 35 parts of an aqueous adhesive consisting of a polyurethane ionomer, 10 parts of a latex prepared by polymerizing a styrene monomer and a butadiene monomer in an aqueous medium containing a polyurethane ionomer, 15 parts of zinc stearate, and 5 parts of potassium stearyl phosphate (product name: Woopol 1800, solids content: 35%, produced by Matsumoto Yushi-Seiyaku Co., Ltd.) were used in the preparation of the uppermost layer coating composition.

Example 3

A heat-sensitive recording material was produced in the same manner as in Example 1 except that 350 parts of synthetic hectorite dispersion, 16 parts of an aqueous adhesive consisting of a polyurethane ionomer, 1.5 parts of a latex prepared by polymerizing a styrene monomer and a butadiene monomer in an aqueous medium containing a polyurethane ionomer, and 3 parts of zinc stearate were used in the preparation of the uppermost layer coating composition.

Example 4

A heat-sensitive recording material was produced in the same manner as in Example 1 except that 25 parts of colloidal silica (product name: Snowtex N, solids content: 20%, produced by Nissan Chemical Industry, Ltd., mean volume diameter: 15 nm) and 100 parts of water were used instead of 270 parts of synthetic hectorite dispersion in the preparation of the uppermost layer coating composition. The average thickness of the uppermost layer was 0.15 μm.

Example 5

A heat-sensitive recording material was produced in the same manner as in Example 1 except that the uppermost layer coating composition was applied in an amount of 0.3 g/m$^2$ on a dry basis. The uppermost layer had an average thickness of 0.3 μm.

Example 6

A heat-sensitive recording material was produced in the same manner as in Example 1 except that, in the preparation of the protective layer coating composition, 12 parts of spherical silica having a 50% mean volume diameter (D50) of 1.5 μm and 90% mean volume diameter (D90) of 2.5 μm (product name: SO-E3, produced by Admatechs Co., Ltd.) was used instead of synthetic zeolite, the protective layer coating composition was applied in an amount of 3.5 g/m$^2$ on a solid basis instead of 1.5 g/m$^2$, and the wetting tension on the surface of the protective layer was adjusted by corona discharge treatment to 55 mN/m instead of 70 mN/m. The average thickness of the protective layer was 3.5 μm. The Martens hardness after the formation of the protective layer was 165 N/mm$^2$.

Comparative Example 1

A heat-sensitive recording material was produced in the same manner as in Example 1 except that 100 parts of water was used instead of 270 parts of synthetic hectorite dispersion in the preparation of the uppermost layer coating composition.

Comparative Example 2

A heat-sensitive recording material was produced in the same manner as in Example 1 except that 12 parts of a 40% slurry of calcined kaolin having a mean volume diameter of 1.5 μm and 100 parts of water were used instead of 270 parts of synthetic hectorite dispersion in the preparation of the uppermost layer coating composition.

Comparative Example 3

A heat-sensitive recording material was produced in the same manner as in Example 1 except that the surface of the protective layer was not subjected to corona discharge treatment and the uppermost layer was not provided.

The heat-sensitive recording materials thus obtained were evaluated for the following properties. Table 1 shows the results.

Gloss

The gloss (according to JIS P8142-1993) of an unrecorded portion on the uppermost layer-side surface of the heat-sensitive recording materials was measured using a gloss meter (product name: GM-26D, produced by Murakami Color Research Laboratory) at incidence angles of 75° and 20°. The gloss of the cured surface of the protective layer before providing the uppermost layer thereon was measured at an incidence angle of 75°.

Absorption

Perspiration from the hands and sebum soiling from the face were applied to the recording surface of the heat-sensitive recording materials, and halftone printing was then performed using a printer (product name: UP-880, produced by Sony Corporation). The degree of sebum absorbed by a solid gray printed portion was evaluated as follows. The more that the sebum soiling appeared on the solid gray printed portion as a dark spot without tailing, the better the absorption evaluation.

A: Sebum soiling appeared on the solid gray printed portion as dark spots without tailing.

B: Sebum soiling appeared on the solid gray printed portion as dark spots but with tailing.

C: Sebum soiling appeared on the solid gray printed portion as light spots with tailing.

D: Sebum soiling did not appear on the solid gray printed portion as spots.

Scratch Off Property

Perspiration from the hands and sebum soiling from the face were applied to the recording surface of the heat-sensitive recording materials, and continuous halftone printing was then performed using a printer (product name: UP-880, produced by Sony Corporation). The level of printing failures (defects in printing that appear as white streaks) was evaluated according to the following criteria.

A: No printing failure was observed right from the start of printing, or printing failures disappeared within several centimeters.

B: Printing failures disappeared within about several tens of centimeters from the start of printing.

C: Printing failures gradually disappeared within about several meters from the start of printing.

D: Printing failures did not disappear after several meters from the start of printing.

Quality of Recorded Image

Halftone printing was performed on the heat-sensitive recording materials using a printer (product name: UP-880, produced by Sony Corporation), and the quality of the recorded portion was evaluated according to the following criteria:

A: Uniform recorded image without white spots.

B: A slight degree of white spots that result in no practical problem.

C: White spots, resulting in a practical problem.

D: Problematical due to noticeable unevenness.

Sticking Resistance

Solid black printing was performed on the heat-sensitive recording materials using a printer (product name: UP-880, produced by Sony Corporation), and the level of sticking (horizontal lines that appear due to skipping in the printed image) was evaluated.

A: Excellent printed image without sticking.

B: Excellent printed image with almost no sticking.

C: Scattered sticking locations, resulting in a practical problem.

D: Problematical due to severe sticking.

TABLE 1

| | Surface gloss (%) | | | | | | |
|---|---|---|---|---|---|---|---|
| | Protective layer | Uppermost layer side | | | Scratch off | Quality of recorded | Sticking |
| | 75° | 75° | 20° | Absorption | property | image | resistance |
| Example 1 | 95 | 95 | 52 | A | A | A | A |
| Example 2 | 93 | 93 | 48 | A | A | A | A |
| Example 3 | 91 | 91 | 45 | A | A | A | A |
| Example 4 | 94 | 94 | 51 | A | A | A | A |
| Example 5 | 94 | 94 | 51 | A | A | A | A |
| Example 6 | 97 | 97 | 54 | B | B | B | A |
| Comp. Ex. 1 | 97 | 97 | 55 | D | D | B | D |
| Comp. Ex. 2 | 80 | 80 | 6 | B | B | C | A |
| Comp. Ex. 3 | 95 | 95 | 52 | D | C | B | C |

Example 7

Preparation of Leuco Dye Dispersion (Dispersion A)

A composition comprising 20 parts of 3-di(n-butyl)amino-6-methyl-7-anilinofluoran, 10 parts of a 10% aqueous solution of polyvinyl alcohol, and 20 parts of water was dispersed using a sand mill to obtain Dispersion A having a mean particle diameter of 1.0 μm. To determine the mean particle diameter, the mean volume diameter was measured using a SALD-2000 laser diffraction particle size analyzer (produced by Shimadzu Corporation).

Preparation of Developer Dispersion (Dispersion B)

A composition comprising 50 parts of 4-hydroxy-4'-isopropoxydiphenylsulfone, 20 parts of a 10% aqueous solution of polyvinyl alcohol, and 60 parts of water was dispersed using a sand mill to obtain Dispersion B having a mean particle diameter of 1.2 μm. To determine the mean particle diameter, the mean volume diameter was measured using a SALD-2000 laser diffraction particle size analyzer (produced by Shimadzu Corporation).

Preparation of Heat-Sensitive Recording Layer Coating Composition

A composition comprising 70 parts of Dispersion A, 75 parts of Dispersion B, 40 parts of a 25% slurry of amorphous silica (product name: Nipsil E-743, produced by Nippon Silica Industrial Co., Ltd.), 50 parts of a 10% aqueous solution of polyvinyl alcohol, 30 parts of a styrene-butadiene-based latex (product name: L-1537, solids content: 50%, produced by Asahi Kasei Corporation), 20 parts of stearamide (product name: Hymicron L-271, solids content: 25%, produced by Chukyo Yushi Co., Ltd.), 2 parts of a 10% aqueous solution of fluoro-containing surfactant (product name: Megafac F-445, produced by DIC Corporation), and 35 parts of water were mixed to obtain a heat-sensitive recording layer coating composition.

Preparation of Intermediate Layer Coating Composition

A composition comprising 70 parts of a 60% slurry of kaolin (product name: UW-90, produced by Engelhard Corporation), 13 parts of zinc stearate (product name: Hidorin Z-8-36, solids content: 36%, produced by Chukyo Yushi Co., Ltd.), 180 parts of a 10% aqueous solution of acetoacetyl-modified polyvinyl alcohol (product name: Gohsefimer Z-200, produced by Nippon Synthetic Chemical Industry Co., Ltd.), 2 parts of a 10% aqueous solution of sodium dioctyl sulfosuccinate, and 120 parts of water were mixed to obtain an intermediate layer coating composition.

Preparation of Protective Layer Coating Composition (Electron-Beam-Curable Resin Composition)

A composition comprising 60 parts of neopentylglycol hydroxypivalate diacrylate (product name: KAYARAD MANDA, produced by Nippon Kayaku Co., Ltd.) as an electron-beam-curable resin and 40 parts of caprolactone-modified dipentaerythritol hexaacrylate (product name: KAYARAD DPCA-60, produced by Nippon Kayaku Co., Ltd.) was mixed with 5 parts of cubic synthetic zeolite having a 50% mean volume diameter (D50) of 1.0 μm and 90% mean volume diameter (D90) of 2.0 μm (product name: SILTON AMT-08L, produced by Mizusawa Industrial Chemicals, Ltd.), and 1 part of fine powder of zinc stearate having a 50% mean volume diameter (D50) of 0.7 μm. The resulting mixture was dispersed using a three roll mill to obtain a protective layer coating composition.

Preparation of Uppermost Layer Coating Composition 5 parts of sodium pyrophosphate was dissolved in 446 parts of water, and 50 parts of a layered silicate compound (product name: Laponite B, mean particle diameter of 40 nm, produced by Rockwood, Inc.), which was synthetic hectorite, was added thereto and then stirred vigorously to obtain a 10% dispersion of the layered silicate compound. A composition comprising 200 parts of an aqueous polyurethane resin (an aqueous adhesive consisting of a polyurethane ionomer, product name: Hydran AP-40, solids content: 22.5%, produced by DIC Corporation), 5 parts of a styrene-butadiene-based latex (product name: Smartex PA-9281, solids content: 40%, produced by Nippon A&L Inc.), 25 parts of zinc stearate (product name: Hymicron L-111, solids content: 20%, produced by Chukyo Yushi Co., Ltd.), 10 parts of a 10% aqueous solution of nonionic surfactant (product name: Olfine E1010, produced by Nissin Chemical Industry Co., Ltd.), 0.94 part of potassium alkyl phosphate (product name: Woopol 1800, solids content: 35%, produced by Matsumoto Yushi-Seiyaku Co., Ltd.), 4.1 parts of acrylic alkali thickener (product name: Somarex 440, solids content: 30%, produced by Somar Corp.), and 1,350 parts of water was mixed into the above-prepared dispersion to obtain an uppermost layer coating composition.

Preparation of Heat-Sensitive Recording Material

The heat-sensitive recording layer coating composition and the intermediate layer coating composition were sequentially applied to one surface of a synthetic paper (product name: YUPO FPG-80, thickness of 80 μm, produced by YUPO Corporation) that served as a support in respective amounts of 8.0 g/m$^2$ and 3.0 g/m$^2$ on a dry basis, by a bar coating method and then dried to form a heat-sensitive recording layer and an intermediate layer. After supercalendering the intermediate layer, the protective layer coating composition was applied by offset gravure coating to the upper surface of the intermediate layer in an application amount of 3.5 g/m$^2$. A protective layer was formed by curing the protective layer coating composition formed of an electron-beam-curable resin composition with an electro-curtain type electron beam accelerator (produced by Energy Sciences, Inc.) using the irradiation of an electron beam with an accelerating voltage of 175 kV and an absorbed dose of 35 kGy. Subsequently, the uppermost layer coating composition was applied by microgravure coating to the upper surface of the protective layer in an amount of 0.15 g/m$^2$ on a dry basis and then dried to form an uppermost layer, thereby obtaining a heat-sensitive recording material.

Example 8

A heat-sensitive recording material was prepared in the same manner as in Example 7 except that the amount of potassium alkyl phosphate used in the preparation of the uppermost layer coating composition was changed from 7.4 parts to 55.1 parts.

Example 9

A heat-sensitive recording material was prepared in the same manner as in Example 7 except that the amount of sodium pyrophosphate used in the preparation of the uppermost layer coating composition was changed from 5 parts to 1 part.

Example 10

A heat-sensitive recording material was prepared in the same manner as in Example 7 except that the amount of sodium pyrophosphate used in the preparation of the uppermost layer coating composition was changed from 5 parts to 12.5 parts.

The heat-sensitive recording materials thus obtained were evaluated for the following properties. Table 2 shows the results.

Gloss

In the same manner as in Example 1, the gloss of an unrecorded portion on the uppermost layer-side surface of the heat-sensitive recording materials was measured at incidence angles of 75° and 20° according to JIS P8142-1993 using a gloss meter (product name: GM-26D, produced by Murakami Color Research Laboratory). The gloss at the incidence angle of 75° is preferably 90% or higher, and more preferably 95% or higher. In order to improve the quality of the recorded image by making the uppermost layer-side surface gloss as close to that of a mirror surface as possible, the gloss at the incidence angle of 20° is preferably 45% or higher, more preferably 55% or higher, and particularly preferably 65% or higher.

Absorption

Absorption was evaluated in the same manner as in Example 1.

Scratch Off Property

The scratch off property was evaluated in the same manner as in Example 1.

Quality of Recorded Image

The quality of the recorded image was evaluated in the same manner as in Example 1.

Sticking Resistance

Sticking resistance was evaluated in the same manner as in Example 1.

Running Performance in the Recording

The heat-sensitive recording material was subjected to humidity control under the conditions of 30° C. and 85% RH for 30 minutes. Recording was conducted thereon under the same conditions, i.e., 30° C. and 85% RH, using a thermal printer (product name: UP-D897, produced by Sony Corporation) having a built-in pattern therein. The resulting solid black printed portion was visually observed and the running performance in the recording was evaluated according to the following criteria.

A: No scratches were observed in the printed portion

B: Almost no scratches were observed in the printed portion.

C: Scratches were observed in the printed portion, resulting in a practical problem.

D: Problematical due to noticeable scratches in the printed portion.

Uneven Dryness

Recording was conducted on the heat-sensitive recording material using a printer (product name: UP-D897, produced by Sony Corporation) having a built-in pattern therein. The resulting solid black printed portion was visually observed under a single fluorescent light so that uneven dryness could be easily detected. The uneven dryness in the printed portion was visually evaluated according to the following criteria.

A: No uneven dryness was observed.

B: Almost no uneven dryness was observed.

C: Uneven dryness was observed, resulting in a practical problem.

D: Problematical due to noticeable uneven dryness.

Water Resistance

Recording was conducted on the heat-sensitive recording material using a printer (product name: UP-D897, produced by Sony Corporation) having a built-in pattern therein. Immediately after applying water dropwise to the surface of the resulting solid black printed portion, the printed portion was rubbed 100 times with a finger to visually evaluate the water resistance of the uppermost layer.

A: No change occurred in the uppermost layer.

B: The uppermost layer swelled and slightly whitened, but no practical problem resulted.

C: A portion of the uppermost layer was eluted and peeled off.

D: The uppermost layer was completely eluted and peeled off.

Stability of Coating Composition

The uppermost layer coating compositions were kept at room temperature and the viscosity of each uppermost layer coating composition was measured every other day using a Brookfield type viscometer (product name: BM, produced by Tokyo Keiki Inc.). The number of days until the viscosity thereof increased by 5 mPa·s or more from that immediately after the preparation was used as the evaluation.

A: Exceeding 10 days

B: Exceeding 7 days but within 10 days

C: Exceeding 3 days but within 7 days

D: Within 3 days

The coating compositions that took more than 7 days in the above evaluation had excellent stability without resulting in uneven coatings, and had no problem in productivity.

Preparation of Intermediate Layer Coating Composition

A composition comprising 70 parts of a 60% slurry of kaolin (product name: UW-90, produced by Engelhard Corporation), 13 parts of zinc stearate (product name: Hidorin Z-8-36, solids content: 36%, produced by Chukyo Yushi Co., Ltd.), 180 parts of a 10% aqueous solution of acetoacetyl-modified polyvinyl alcohol (product name: Gohsefimer (registered trademark) Z-200, produced by Nippon Synthetic Chemical Industry Co., Ltd.), 2 parts of a 10% aqueous solution of sodium dioctyl sulfosuccinate, and 120 parts of water were mixed to obtain an intermediate layer coating composition.

TABLE 2

| | Gloss (%) | | | Scratch off | Quality of recorded | Sticking | Running performance in the | Uneven | Water | Stability of coating |
|---|---|---|---|---|---|---|---|---|---|---|
| | 75° | 20° | Absorption | Property | image | resistance | recording | dryness | resistance | composition |
| Ex. 7 | 98 | 70 | A | A | A | B | C | B | B | A |
| Ex. 8 | 98 | 67 | A | A | A | A | A | B | B | C |
| Ex. 9 | 97 | 70 | A | A | A | A | A | B | B | D |
| Ex. 10 | 98 | 68 | B | B | A | A | C | B | C | A |

Example 11

Preparation of Leuco Dye Dispersion (Dispersion A)

A composition comprising 20 parts of 3-di(n-butyl)amino-6-methyl-7-anilinofluoran, 10 parts of a 10% aqueous solution of polyvinyl alcohol, and 20 parts of water was dispersed using a sand mill to obtain Dispersion A having a mean particle diameter of 1.0 μm. To determine the mean particle diameter, the mean volume diameter was measured using a SALD-2000 laser diffraction particle size analyzer (produced by Shimadzu Corporation).

Preparation of Developer Dispersion (Dispersion B)

A composition comprising 50 parts of 4-hydroxy-4'-isopropoxydiphenylsulfone, 20 parts of a 10% aqueous solution of polyvinyl alcohol, and 60 parts of water was dispersed using a sand mill to obtain Dispersion B having a mean particle diameter of 1.2 μm. To determine the mean particle diameter, the mean volume diameter was measured using a SALD-2000 laser diffraction particle size analyzer (produced by Shimadzu Corporation).

Preparation of Heat-Sensitive Recording Layer Coating Composition

A composition comprising 70 parts of Dispersion A, 75 parts of Dispersion B, 40 parts of a 25% slurry of amorphous silica (product name: Nipsil E-743, produced by Nippon Silica Industrial Co., Ltd.), 50 parts of a 10% aqueous solution of polyvinyl alcohol, 30 parts of a styrene-butadiene-based latex (product name: L-1537, solids content: 50%, produced by Asahi Kasei Corporation), 20 parts of stearamide (product name: Hymicron L-271, solids content: 25%, produced by Chukyo Yushi Co., Ltd.), 2 parts of a 10% aqueous solution of fluoro-containing surfactant (product name: Megafac F-445, produced by DIC Corporation), and 35 parts of water were mixed to obtain a heat-sensitive recording layer coating composition.

Preparation of Protective Layer Coating Composition (Electron-Beam-Curable Resin Composition)

A composition comprising 60 parts of neopentylglycol hydroxypivalate diacrylate (product name: KAYARAD MANDA, produced by Nippon Kayaku Co., Ltd.) as an electron-beam-curable resin and 40 parts of caprolactone-modified dipentaerythritol hexaacrylate (product name: KAYARAD DPCA-60, produced by Nippon Kayaku Co., Ltd.) was mixed with 5 parts of cubic synthetic zeolite having a 50% mean volume diameter (D50) of 1.0 and 90% mean volume diameter (D90) of 2.0 μm (product name: SILTON AMT-08L, produced by Mizusawa Industrial Chemicals, Ltd.), and 1 part of zinc stearate fine powder having a 50% mean volume diameter (D50) of 0.7 μm. The resulting mixture was dispersed using a three roll mill to obtain a protective layer coating composition.

Preparation of Uppermost Layer Coating Composition 5 parts of sodium pyrophosphate was dissolved in 446 parts of water, and 50 parts of a layered silicate compound (product name: Laponite B, mean particle diameter of 40 nm, produced by Rockwood, Inc.), which was synthetic hectorite, was added thereto and then stirred vigorously to obtain a 10% dispersion of the layered silicate compound. A composition comprising 200 parts of an aqueous polyurethane resin (product name: Hydran AP-40, solids content: 22.5%, produced by DIC Corporation), 5 parts of a styrene-butadiene-based latex (product name: Smartex PA-9281, solids content: 40%, produced by Nippon A&L Inc.), 25 parts of zinc stearate (product name: Hymicron L-111, solids content: 20%, produced by Chukyo Yushi Co., Ltd.), 10 parts of a 10% aqueous solution of nonionic surfactant (product name: Olfine E1010, produced by Nissin Chemical Industry Co., Ltd.), 7.4 parts of potassium alkyl phosphate (product name: Woopol 1800, solids content: 35%, produced by Matsumoto Yushi-Seiyaku Co., Ltd.), 4.1 parts of acrylic alkali thickener (product name: Somarex 440, solids content: 30%, produced by Somar Corp.), and 1,350 parts of water were mixed into the above-prepared dispersion to obtain an uppermost layer coating composition.

Preparation of Heat-Sensitive Recording Material

The heat-sensitive recording layer coating composition and the intermediate layer coating composition were sequentially applied to one surface of a synthetic paper (product name: YUPO FPG-80, thickness of 80 μm, produced by YUPO Corporation) that served as a support in respective amounts of 8.0 g/m$^2$ and 3.0 g/m$^2$ on a dry basis, by a bar coating method and then dried to form a heat-sensitive recording layer and an intermediate layer. After supercalendering the intermediate layer, the protective layer coating composition was applied by offset gravure coating to the upper surface of the intermediate layer in an application amount of 3.5 g/m$^2$. A protective layer was formed by curing the protective layer coating composition formed of an electron-beam-curable resin composition with an electro-curtain type electron beam accelerator (produced by Energy Sciences, Inc.) using the irradiation of an electron beam with an accelerating voltage of 175 kV and an absorbed dose of 35 kGy. Subsequently, the uppermost layer coating composition was applied by microgravure coating onto the upper surface of the protective layer in an amount of 0.15 g/m$^2$ on a dry basis and then dried to form an uppermost layer, thereby obtaining a heat-sensitive recording material.

Example 12

A heat-sensitive recording material was prepared in the same manner as in Example 11 except that the amount of potassium alkyl phosphate used in the preparation of the uppermost layer coating composition was changed from 7.4 parts to 1.9 parts.

Example 13

A heat-sensitive recording material was prepared in the same manner as in Example 11 except that the amount of potassium alkyl phosphate used in the preparation of the uppermost layer coating composition was changed from 7.4 parts to 30.9 parts.

Example 14

A heat-sensitive recording material was prepared in the same manner as in Example 11 except that the amount of acrylic alkali thickener used in the preparation of the uppermost layer coating composition was changed from 4.1 parts to 0.53 part.

Example 15

A heat-sensitive recording material was prepared in the same manner as in Example 11 except that the amount of acrylic alkali thickener used in the preparation of the uppermost layer coating composition was changed from 4.1 parts to 10.3 parts.

Example 16

A heat-sensitive recording material was prepared in the same manner as in Example 11 except that 6.6 parts of a 1% aqueous solution of polyethylene oxide (product name: PEO-3Z, viscosity-average molecular weight: 600,000 to 1,100,000, produced by Sumitomo Seika Chemicals Co., Ltd.) was used instead of 4.1 parts of acrylic alkali thickener in the preparation of the uppermost layer coating composition.

Example 17

A heat-sensitive recording material was prepared in the same manner as in Example 11 except that 11 parts of a 1% aqueous solution of polyethylene oxide (product name: PEO-3Z, viscosity average molecular weight: 600,000 to 1,100,000, produced by Sumitomo Seika Chemicals Co., Ltd.) was used instead of 4.1 parts of acrylic alkali thickener in the preparation of the uppermost layer coating composition.

Example 18

A heat-sensitive recording material was prepared in the same manner as in Example 11 except that 50 parts of a 1% aqueous solution of polyethylene oxide (product name: PEO-3Z, viscosity average molecular weight: 600,000 to 1,100,000, produced by Sumitomo Seika Chemicals Co., Ltd.) was used instead of 4.1 parts of acrylic alkali thickener in the preparation of the uppermost layer coating composition.

Example 19

A heat-sensitive recording material was prepared in the same manner as in Example 11 except that 6.6 parts of a 1% aqueous solution of xanthan gum (product name: Kelzan ASX-T, produced by Sansho Co., Ltd.) was used instead of 4.1 parts of acrylic alkali thickener in the preparation of the uppermost layer coating composition.

Example 20

A heat-sensitive recording material was prepared in the same manner as in Example 11 except that 11 parts of a 1% aqueous solution of xanthan gum (product name: Kelzan ASX-T, produced by Sansho Co., Ltd.) was used instead of 4.1 parts of acrylic alkali thickener in the preparation of the uppermost layer coating composition.

Example 21

A heat-sensitive recording material was prepared in the same manner as in Example 11 except that 50 parts of a 1% aqueous solution of xanthan gum (product name: Kelzan ASX-T, produced by Sansho Co., Ltd.) was used instead of 4.1 parts of acrylic alkali thickener in the preparation of the uppermost layer coating composition.

Example 22

A heat-sensitive recording material was prepared in the same manner as in Example 11 except that 6.6 parts of a 1% aqueous solution of sodium polyacrylate (product name: Aqualic FH-G, produced by Nippon Shokubai Co., Ltd.) was used instead of 4.1 parts of acrylic alkali thickener in the preparation of the uppermost layer coating composition.

Example 23

A heat-sensitive recording material was prepared in the same manner as in Example 11 except that 11 parts of a 1% aqueous solution of sodium polyacrylate (product name: Aqualic FH-G, produced by Nippon Shokubai Co., Ltd.) was used instead of 4.1 parts of acrylic alkali thickener in the preparation of the uppermost layer coating composition.

Example 24

A heat-sensitive recording material was prepared in the same manner as in Example 11 except that 50 parts of a 1% aqueous solution of sodium polyacrylate (product name: Aqualic FH-G, produced by Nippon Shokubai Co., Ltd.) was used instead of 4.1 parts of acrylic alkali thickener in the preparation of the uppermost layer coating composition.

Example 25

A heat-sensitive recording material was prepared in the same manner as in Example 11 except that the amount of sodium pyrophosphate used in the preparation of the uppermost layer coating composition was changed from 5 parts to 2 parts.

Example 26

A heat-sensitive recording material was prepared in the same manner as in Example 11 except that the amount of sodium pyrophosphate used in the preparation of the uppermost layer coating composition was changed from 5 parts to 9 parts.

The heat-sensitive recording materials thus obtained were evaluated in terms of gloss, absorption, scratch off property, quality of recorded image, sticking resistance, running performance in the recording, uneven dryness, water resistance, and stability of coating composition in the same manner as in Examples 1 and 7. Table 3 shows the results.

TABLE 3

| | Gloss (%) | | | Scratch off | Quality of recorded | Sticking | Running performance in the | Uneven | Water | Stability of coating |
|---|---|---|---|---|---|---|---|---|---|---|
| | 75° | 20° | Absorption | property | image | resistance | recording | dryness | resistance | composition |
| Ex. 11 | 98 | 67 | A | A | A | A | A | B | B | A |
| Ex. 12 | 98 | 69 | A | A | A | B | B | B | B | A |
| Ex. 13 | 98 | 68 | A | A | A | A | A | B | B | B |
| Ex. 14 | 98 | 71 | A | A | A | A | B | B | A | A |
| Ex. 15 | 98 | 62 | A | A | A | A | B | A | B | B |
| Ex. 16 | 98 | 71 | A | A | B | A | B | B | A | A |
| Ex. 17 | 98 | 70 | A | A | B | A | B | B | A | B |
| Ex. 18 | 98 | 62 | A | A | B | A | B | A | B | B |
| Ex. 19 | 98 | 70 | A | A | B | A | B | B | A | A |
| Ex. 20 | 98 | 68 | A | A | B | A | B | B | A | B |
| Ex. 21 | 98 | 63 | A | A | B | A | B | A | B | B |
| Ex. 22 | 98 | 72 | A | A | B | A | B | B | A | A |
| Ex. 23 | 98 | 69 | A | A | B | A | B | B | A | B |
| Ex. 24 | 98 | 62 | A | A | B | A | B | A | B | B |
| Ex. 25 | 98 | 70 | A | A | A | A | A | B | B | B |
| Ex. 26 | 98 | 67 | A | A | A | A | B | B | B | A |

INDUSTRIAL APPLICABILITY

The heat-sensitive recording material of the present invention has a high gloss, and excellent absorption and scratch off properties against sebum soiling. The heat-sensitive recording material of the invention also exhibits excellent quality in the recorded image and sticking resistance. This allows the heat-sensitive recording material of the present invention to be used in medical equipment or in imaging diagnosis, such as ultrasonographic image diagnosis, magnetic resonance image diagnosis, and X-ray image diagnosis.

The invention claimed is:

1. A heat-sensitive recording material comprising a heat-sensitive recording layer, an intermediate layer, and a protective layer, which are sequentially formed in this order on a support, wherein the heat-sensitive recording layer contains a leuco dye and a developer; the intermediate layer contains an aqueous adhesive; and the protective layer is a cured form obtained by irradiation of an ultraviolet- or electron-beam-curable resin composition with ultraviolet light or an electron beam;

the heat-sensitive recording material further comprising, on the protective layer, an uppermost layer containing an aqueous adhesive and a pigment having a mean particle diameter of not more than 100 nm, wherein the uppermost layer-side surface of the heat-sensitive recording material has a gloss at 75° of not less than 90% and a gloss at 20° of not less than 35% in accordance with JIS P 8142-1993.

2. The heat-sensitive recording material according to claim 1, wherein the uppermost layer contains an aqueous adhesive comprising a polyurethane ionomer.

3. The heat-sensitive recording material according to claim 1 or 2, wherein the pigment comprises one member selected from the group consisting of layered silicate compounds and colloidal silica, and the content of one member selected from the group consisting of layered silicate compounds and colloidal silica is 20 to 70 mass %, based on the total solids content of the uppermost layer.

4. The heat-sensitive recording material according to claim 1 or 2, wherein the uppermost layer contains a resin obtained from the aqueous adhesive, which is a polymer latex having a heterogeneous particle structure containing a urethane resin component in at least one phase.

5. The heat-sensitive recording material according to claim 1 or 2, wherein the uppermost layer has an average thickness of 0.02 to 0.4 μm, and the average thickness is not less than a mean particle diameter of the pigment.

6. The heat-sensitive recording material according to claim 1 or 2, wherein the protective layer contains a filler having a 50% mean volume particle diameter (D50) of less than 2.0 μm as determined from the cumulative volume distribution, and a ratio of the 90% mean volume particle diameter (D90) to the 50% mean volume particle diameter (D50) (D90/D50) of not more than 3.0, and the protective layer has an average thickness of 0.5 to 5 μm, and the average thickness is not less than a mean particle diameter of the filler.

7. The heat-sensitive recording material according to claim 1 or 2, wherein the protective layer contains at least one filler selected from the group consisting of synthetic zeolite and spherical silica.

8. The heat-sensitive recording material according to claim 1 or 2, wherein the protective layer surface has a gloss at 75° of not less than 90% in accordance with JIS P 8142-1993 and a wetting tension of not less than 50 mN/m.

9. The heat-sensitive recording material according to claim 1 or 2, wherein the uppermost layer is formed by using an uppermost layer coating composition containing an alkyl phosphate;

an alkali metal pyrophosphate; and at least one thickener selected from the group consisting of acrylic alkali thickeners, polyethylene oxide, xanthan gum, and sodium polyacrylate; and wherein the alkyl phosphate content is 0.5 to 10 mass %, based on the total solids content of the uppermost layer, and the alkali metal pyrophosphate content is 3 to 20 mass %, based on the pigment.

10. The heat-sensitive recording material according to claim 9, wherein the acrylic alkali thickener content is 0.1 to 3 mass %, based on the total solids content of the uppermost layer.

11. The heat-sensitive recording material according to claim 9, wherein the content of at least one member selected from the group consisting of polyethylene oxide, xanthan gum, and sodium polyacrylate is 0.05 to 0.5 mass %, based on the total solids content of the uppermost layer.

12. A method for producing a heat-sensitive recording material according to claim 1 or 2, wherein the heat-sensitive recording material comprising a heat-sensitive recording layer, an intermediate layer, and a protective layer, which are sequentially formed in this order on a support, the heat-sensitive recording layer containing a leuco dye and a developer, the intermediate layer containing an aqueous adhesive, and the protective layer being cured by irradiation of an ultraviolet- or electron-beam-curable resin composition with ultraviolet light or an electron beam, applying to the protective layer an uppermost layer coating composition containing an aqueous adhesive and a pigment with a mean particle diameter of not more than 100 nm and drying the composition to form an uppermost layer, wherein the uppermost layer-side surface has a gloss at 75° of not less than 90% and a gloss at 20° of not less than 35% in accordance with JIS P 8142-1993.

* * * * *